US008496392B2

(12) United States Patent
Windorski

(10) Patent No.: US 8,496,392 B2
(45) Date of Patent: Jul. 30, 2013

(54) WRITING INSTRUMENT WITH SHEET DISPENSER

(75) Inventor: David C. Windorski, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 618 days.

(21) Appl. No.: 12/236,794

(22) Filed: Sep. 24, 2008

(65) Prior Publication Data

US 2009/0080962 A1 Mar. 26, 2009

Related U.S. Application Data

(60) Provisional application No. 60/975,334, filed on Sep. 26, 2007.

(51) Int. Cl.
*B43K 29/00* (2006.01)

(52) U.S. Cl.
USPC ..... 401/195; 401/202; 401/52

(58) Field of Classification Search
USPC ..... 401/52, 195, 202, 213, 243, 17, 21, 401/23; 221/199, 45, 46, 282, 52
See application file for complete search history.

(56) References Cited

U.S. PATENT DOCUMENTS

| | | | | |
|---|---|---|---|---|
| 1,261,077 | A | | 4/1918 | Walsh |
| D181,244 | S | | 10/1957 | Zierhut |
| D182,162 | S | | 2/1958 | Carreiro |
| D182,216 | S | | 2/1958 | Zierhut |
| 3,075,496 | A | | 1/1963 | Zepelovitch |
| 3,140,694 | A | | 7/1964 | Reed |
| 3,251,343 | A | | 5/1966 | Wesenberg |
| 3,602,600 | A | | 8/1971 | Kanski |
| D223,688 | S | | 5/1972 | Schnur et al. |
| 5,165,570 | A | * | 11/1992 | Windorski et al. ..... 221/46 |
| D331,779 | S | | 12/1992 | Hu |
| D342,546 | S | | 12/1993 | Song |
| D354,985 | S | | 1/1995 | Hong |
| 5,433,782 | A | | 7/1995 | Filbert et al. |
| 5,769,270 | A | * | 6/1998 | Fujisawa et al. ..... 221/34 |
| D395,875 | S | | 7/1998 | Aiken et al. |
| 5,938,010 | A | | 8/1999 | Osterbye |
| D428,926 | S | | 8/2000 | Windorski |
| D437,352 | S | | 2/2001 | Matsuzaki et al. |
| 6,206,595 | B1 | | 3/2001 | Keda |
| 6,257,789 | B1 | | 7/2001 | Podszuweit et al. |
| D457,185 | S | | 5/2002 | Ham |

(Continued)

FOREIGN PATENT DOCUMENTS

| | | |
|---|---|---|
| JP | 11-139081 | 5/1999 |
| KR | 2000-0013021 | 7/2000 |

(Continued)

*Primary Examiner* — David Walczak
*Assistant Examiner* — Jennifer C Chiang
(74) *Attorney, Agent, or Firm* — Robert H. Jordan

(57) ABSTRACT

A writing instrument is provided. The instrument has (a) a body having opposing first and second ends, the body comprising a marking element extending from one or both ends, and (b) a sheet dispenser coupled to a first cap that is able to engage the first or the second end of the body portion, the dispenser comprising (i) a base disposed on the first cap; and (ii) a cover removably, e.g., slideably, engageable with the base, wherein the dispenser is disposed axially along a centerline of the writing element.

14 Claims, 5 Drawing Sheets

U.S. PATENT DOCUMENTS

| | | | | |
|---|---|---|---|---|
| 6,412,998 | B1 | 7/2002 | Ham | |
| D482,397 | S | 11/2003 | Hui | |
| D497,387 | S | 10/2004 | Cetera | |
| D501,253 | S | 1/2005 | Bainton | |
| D502,737 | S | 3/2005 | Bodino | |
| 7,086,798 | B1 | 8/2006 | Cetera | |
| D531,217 | S | 10/2006 | Hirota | |
| 7,114,870 | B2 | 10/2006 | Windorski et al. | |
| D535,693 | S | 1/2007 | Gahlow et al. | |
| D551,709 | S | 9/2007 | Pellissa Beneyto | |
| 7,322,766 | B2 * | 1/2008 | Erlebacher et al. | 401/195 |
| D562,390 | S | 2/2008 | Qiu et al. | |
| D564,582 | S | 3/2008 | Windorski | |
| D564,584 | S | 3/2008 | Windorski et al. | |
| 7,374,356 | B2 * | 5/2008 | Oike | 401/23 |
| 7,377,708 | B2 * | 5/2008 | Hageman et al. | 401/131 |
| D580,494 | S | 11/2008 | Delancourt | |
| D581,978 | S | 12/2008 | Windorski et al. | |
| D591,349 | S | 4/2009 | Delancourt | |
| 7,517,167 | B2 | 4/2009 | Smith, Jr. et al. | |
| D592,247 | S | 5/2009 | Brown | |
| 7,547,155 | B2 * | 6/2009 | Windorski | 401/195 |
| D601,190 | S | 9/2009 | Liu | |
| 2003/0000958 | A1 | 1/2003 | Windorski | |
| 2005/0191114 | A1 | 9/2005 | Smith, Jr. et al. | |
| 2008/0075524 | A1 | 3/2008 | Erlebacher et al. | |

FOREIGN PATENT DOCUMENTS

| | | | |
|---|---|---|---|
| KR | 20-0371440 | | 1/2005 |
| KR | 20-0397228 | | 9/2005 |
| KR | 20-0397282 | | 9/2005 |
| KR | 20-0405132 | | 1/2006 |
| WO | WO 2005/070700 | A2 | 8/2005 |

* cited by examiner

WRITING INSTRUMENT WITH SHEET DISPENSER

PRIORITY CLAIM

This application claims priority to U.S. Provisional Patent Application No. 60/975,334, filed Sep. 26, 2007.

FIELD OF INVENTION

This invention relates to writing instruments, in particular, writing instruments that incorporate a sheet dispenser within the cap.

BACKGROUND

3M Company has introduced a wide variety of products and services to help consumers and office workers communicate, organize, and manage their information. For example, Post-it® Flags, have proven to be extremely useful for marking specific areas of documents, magazines, books, and the like. In general, the flag (also referred to as an "index"), is a polymeric or paper based material having a first and second end portions and first and second opposing major surfaces. The flag includes a repositionable adhesive one of a first or a second portion of its first or second major surface. In a polymeric flag, the first portion is typically transparent and is larger in size than the second portion, which is generally brightly colored. A plurality of flags is releaseably adhered to one another in a fan-fold (also referred to as "z-stacked") configuration such that the repositionable adhesive in alternating flags is at alternating ends of the stack.

The flags have been integrated into writing instruments such as pens and highlighters. For example, 3M Company sells Post-it® highlighters and Post-it® pens. These integrated writing instruments provide a portable and convenient way to have flags readily available for a user wherever (s)he goes. Sheet material dispensers such as for flags integrated into pens and highlighters are described in, e.g., U.S. Pat. No. 6,719,472 (Windorski et al.), U.S. Pat. No. 7,144,870 (Windorski et al.), and U.S. Pat. No. 7,322,766 (Erlebacher et al.), and US Patent Publication No. 2005/0191114 (Smith et al.), and in Japanese Patent Application Publication Nos. JP2000025385 and JP11139081.

While the foregoing products are very useful, there is a desire to those skilled in the art for continued innovation of consumer related products.

SUMMARY

The present invention pertains to a writing instrument having a sheet dispenser integrated into a cap of the instrument. In one aspect, the dispenser and a first cap of the writing instrument are formed as an integral unit.

The writing dispenser comprises (a) a body having opposing first and second ends, the body comprising a marking element extending from one or both ends, and (b) a sheet dispenser coupled to a first cap that is able to engage the first or the second end of the body portion, the dispenser comprising (i) a base disposed on the first cap; and (ii) a cover removable from (e.g., slideably engageable with) the base, wherein the dispenser is disposed axially along a centerline of the writing element.

Advantageously, in one exemplary embodiment, the base of the sheet dispenser and the first cap are injection molded as an integral unit. With a removable cover, the sheet dispenser is refillable with a new stack of sheets once a current stack has been consumed. The stack of sheets useful in this disclosure can be in a z-stacked configuration or a non z-stacked configuration. In the latter case, the repositionable adhesive are aligned at one end of the stack.

BRIEF DESCRIPTION OF THE DRAWINGS

The present disclosure can be better explained with reference to the drawings, wherein.

Figure 1:
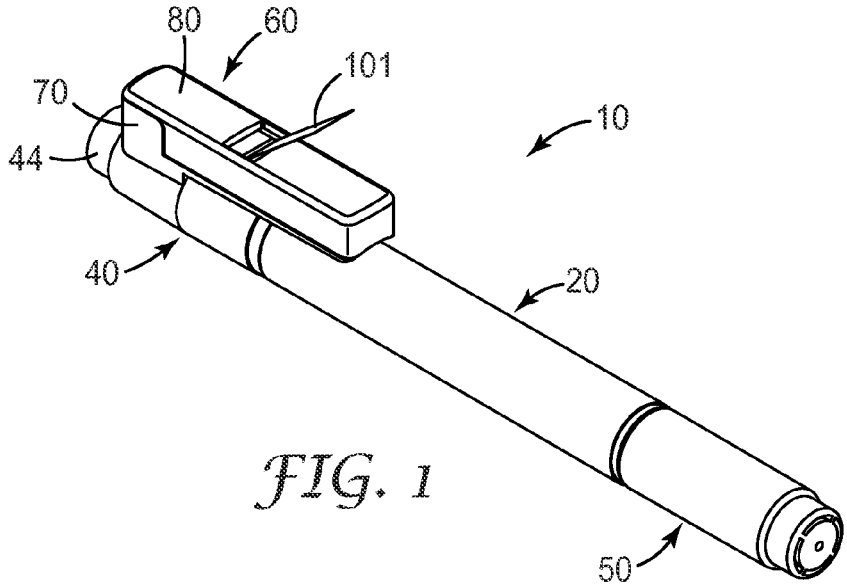
FIG. 1 is a perspective view of an exemplary writing instrument.
Figure 2:
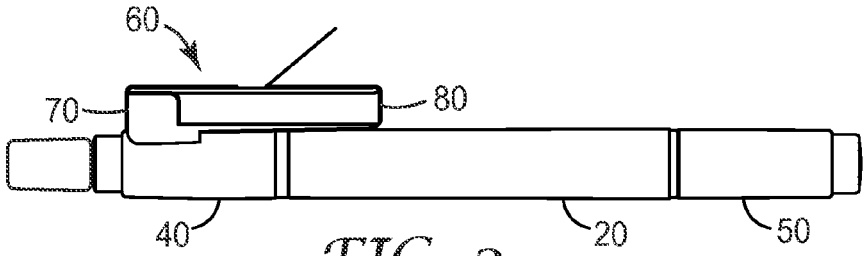
FIG. 2 is a side view of the writing instrument of FIG. 1.
Figure 3:
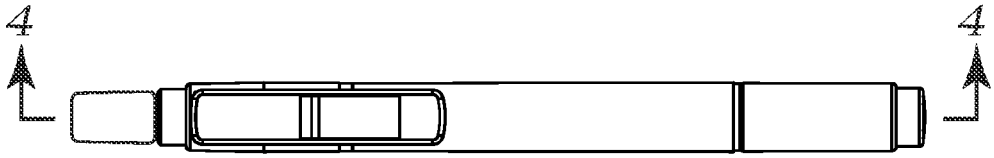
FIG. 3 is a top plan view of the writing instrument of FIG. 1.
Figure 4:
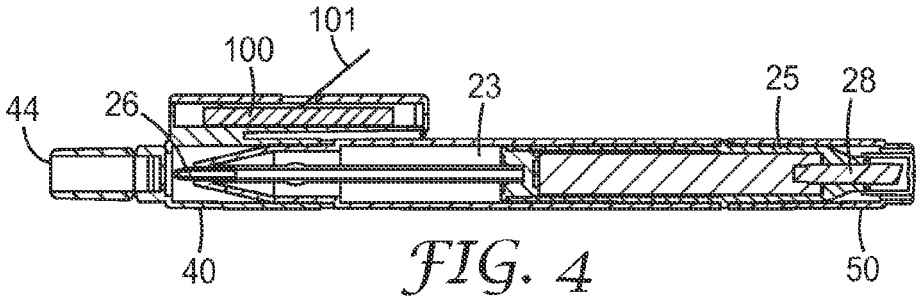
FIG. 4 is a cross-section view of FIG. 3 taken along line 4-4.

The drawings present the disclosure by way of representations and not limitation. Numerous other modifications and embodiments can be devised by one skilled in the art which fall within the scope and spirit of the principals of this invention. The figures are idealized, are not drawn to scale, and are intended merely for illustrative purposes.

DETAILED DESCRIPTION OF ILLUSTRATIVE EMBODIMENTS

The present disclosure provides a writing instrument integrated with a sheet dispenser. Because the dispenser has a compact footprint, it can be integrated into a first cap of the writing instrument.

In this document, all numbers are assumed to be modified by the term "about".

Turning now to the figures, FIGS. 1 to 4 depict various views of a writing instrument 10. The writing instrument has a body section 20 that is in communication with a first cap 40 having a sheet dispenser 60 integrated thereon. The body provides a gripping surface where a user holds the writing instrument during use. As better shown in FIG. 4, the body holds a first writing element 26 disposed in a first barrel 23. When not in use, the first writing element 26 is protected in the first cap 40. In this particular embodiment, the writing instrument includes a second writing element 28 disposed in a second barrel 25. When not in use, the second writing element is protected by a second cap 50. The sheet dispenser 60 includes a base 70 slidably engaged with a cover 80. A stack of sheet 100 is disposed in the dispenser with an uppermost sheet 101 in the stack extending therefrom. The writing instrument has a centerline axis that runs along its length. In one exemplary embodiment, the sheet dispenser 60 is elongated, almost rectangular like, and its longest axis lies parallel to the centerline axis of the writing instrument.

Figure 5:
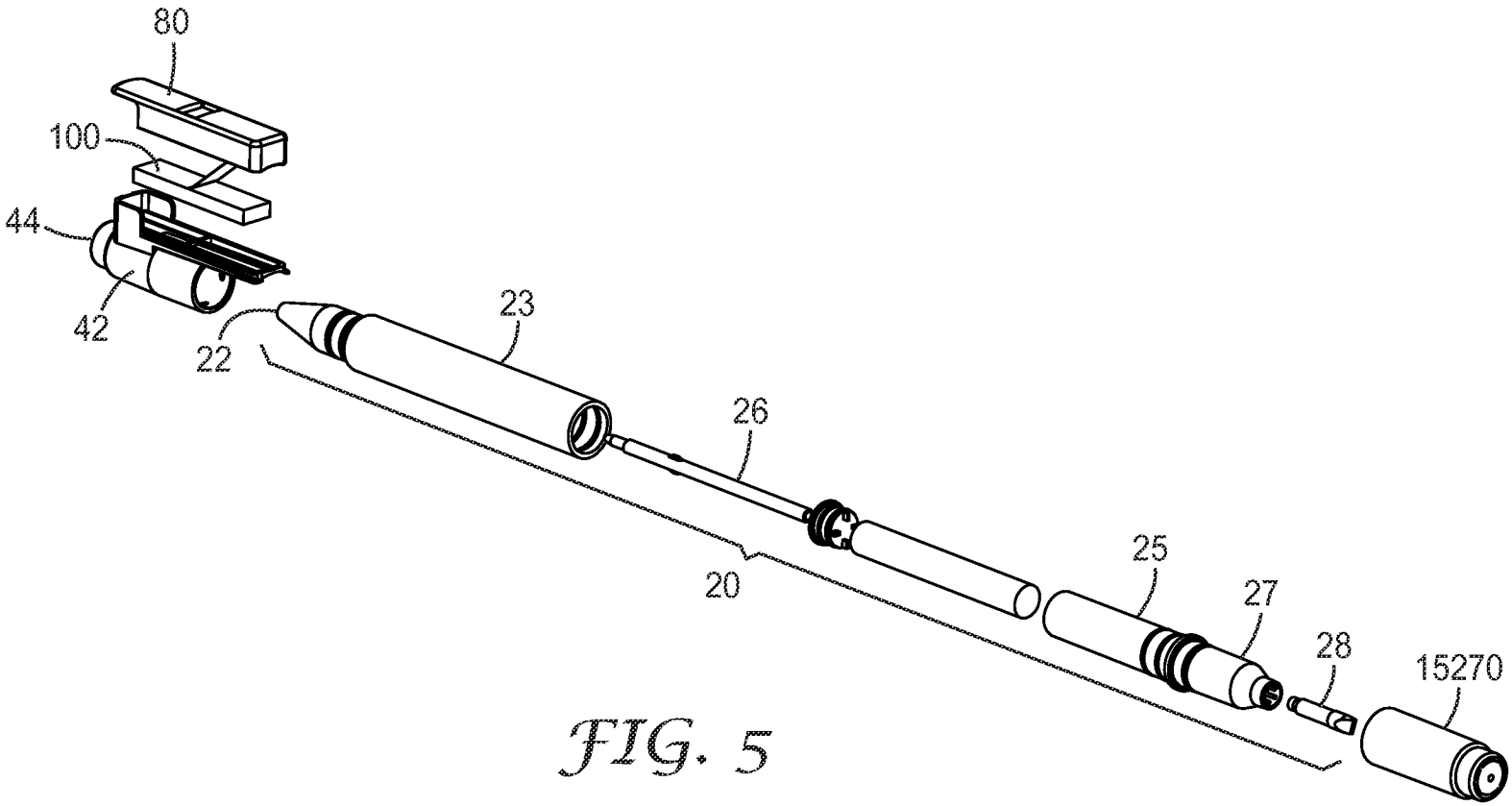
FIG. 5 is an exploded view of the writing instrument of FIG. 1.
Figure 6:
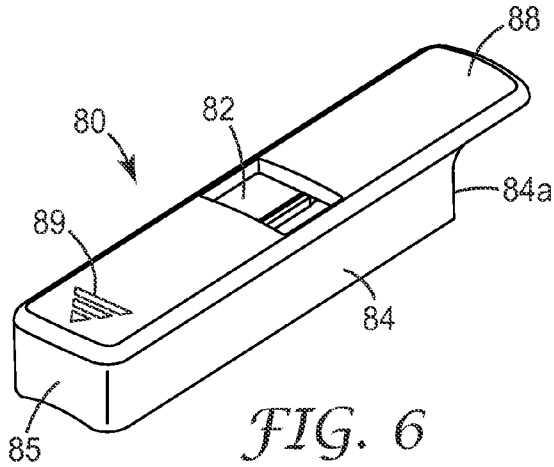
FIG. 6 is a perspective view of an exemplary cover for use with the writing instrument of FIG. 1.
Figure 7:
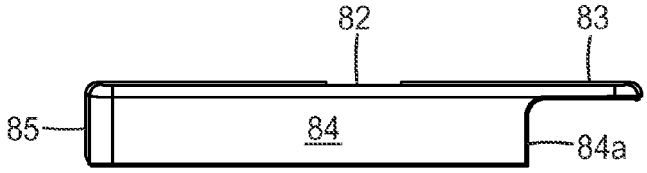
FIG. 7 is a side view of the cover of FIG. 6.
Figure 8:
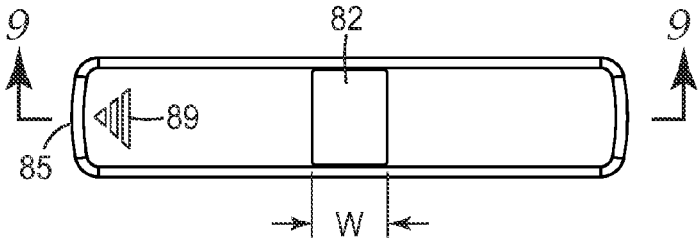
FIG. 8 is a top plan view of the cover of FIG. 6.
Figure 9:
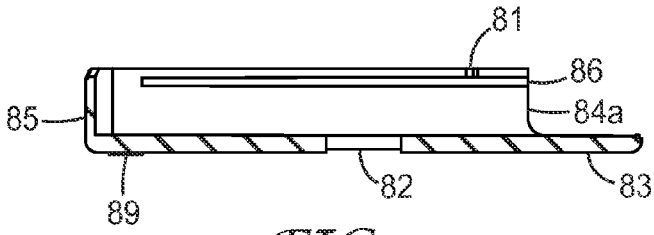
FIG. 9 is a cross-section view of FIG. 8 taken along line 9-9.

FIG. 5 depicts an exploded view of the writing instrument of FIG. 1. As can be seen, the first cap 40 includes an end portion 44, which optionally is detachable from, a closure portion 42. In one exemplary embodiment, a lanyard is attached to the end portion. The body 20 of the writing instrument includes the first barrel 23 where the first marking element 26 is housed and a tip of the first marking element extends from a first end 22 of the first barrel. The first barrel 23 slideably engages with a second barrel 25 where the second marking element 28 is housed and a tip of the second marking elements extends from a first end 27 of the second barrel. When the writing instrument is not in use, typically the user would put the first cap 40 or the second cap 50 on the first end 22 of the first barrel 23 or the first end 27 of the second barrel 25.

The first and second marking elements may be selected from many known marking means, e.g., crayon, pigment (e.g., pencil), ink-based elements (such as a pen), or fluid based elements (such as a highlighter). In one exemplary embodiment, the first and second marking elements both are ink based. In another exemplary embodiment, the first and second marking elements are both fluid based. In yet another element the first marking element is ink-based and the second marking element is fluid based, or vice-versa.

Figure 10:
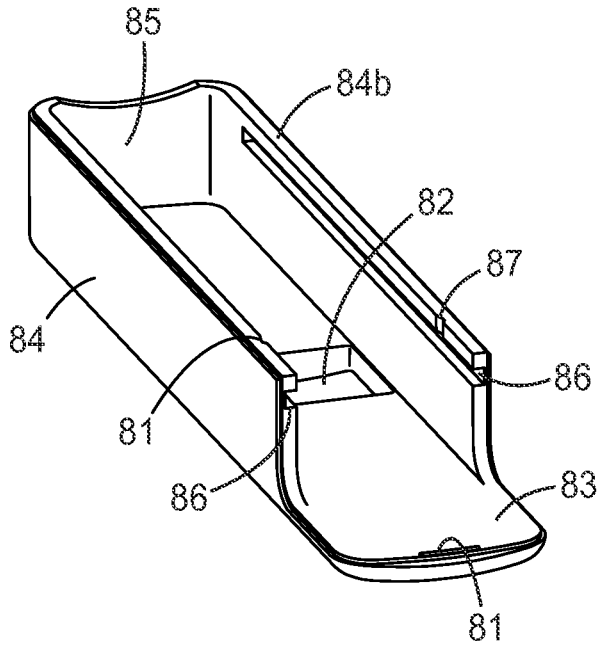
FIG. 10 is a perspective view of the cover of FIG. 6 looking from its inside.
Figure 11:
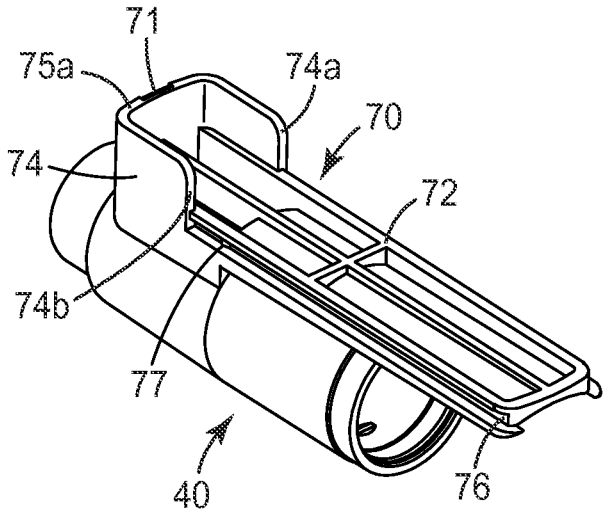
FIG. 11 is perspective view of an exemplary first cap for use with the writing instrument of FIG. 1.
Figure 12:
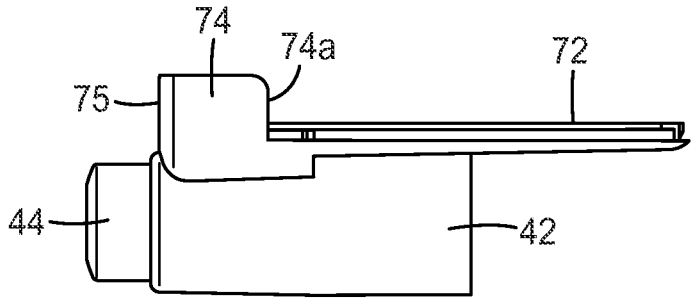
FIG. 12 is side view of the first cap of FIG. 11.
Figure 13:
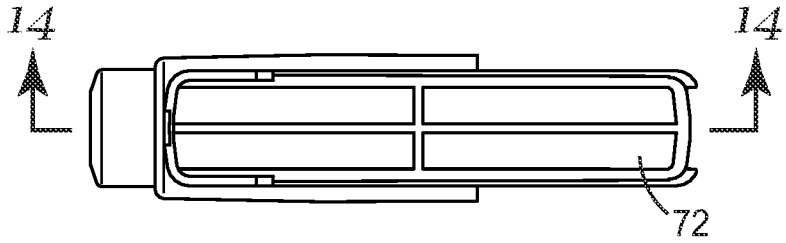
FIG. 13 is a top plan view of the first cap of FIG. 11.
Figure 14:
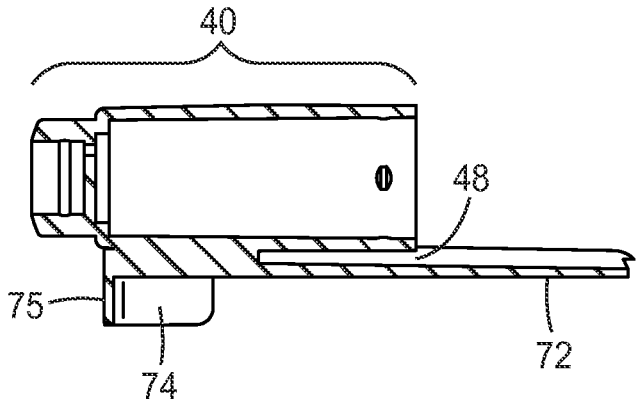
FIG. 14 is a cross-sectional view of FIG. 13 taken along line 14-14.

FIGS. 6 to 10 show various views of an exemplary cover 80 that can be used for the dispenser of the writing instrument of FIG. 1. A slot 82 is disposed about midway on a top surface of the dispenser. The top surface further includes a tongue 83 disposed on one side and a back disposed on the other side of the slot 82. Optionally, a marking 89 is disposed on the back to indicate how to remove the cover from the dispenser. Extending laterally from the top are sidewalls 84 and a front wall 85. The sidewalls 84 are shortened as compared to the length of the top of the cover 80. Thus, as can be seen in these figures, the sidewall is truncated at surface 84*a*. The tongue 83 is essentially that portion of the top that starts from the truncated surface 84*a*. Both sidewalls 84 further include a groove 86 that extends from truncated surface 84*a* to almost but, in this embodiment, not up to the front wall 85. As best depicted in FIG. 10, the groove 86 lies on the inside surface of the cover staggered a distance away from a sidewall bottom surface 84*b*. A substantially V-shaped notch 87 is in the sidewall between the groove and the sidewall bottom surface 84*b*. The groove and notch provide a mechanical system for the cover to slideably engage with the base. On the tongue of the inside surface of the cover, there is optionally a latch 81 for mating with the base.

The slot 82 provides an opening for a top most sheet in the stack of sheets to extend from the dispenser. The slot width is denoted in FIG. 8 as the distance W. The slot width is sufficiently wide to allow for the dispensing of the sheets.

While FIGS. 6 to 10 show a cover with the slot consuming only a portion of the available surface area of the top, in another exemplary embodiment, the slot consumes most of the top. In such an embodiment, the back wall and side walls of the cover, along with the back wall and sidewalls of the base (as described below in FIGS. 11 to 14) provide sufficient structure to the dispenser such that a non z-stacked stack of sheets can be used in the dispenser. A bottom most sheet of the non z-stacked stack of sheets can be adhesively attached to the base.

In yet another embodiment, the writing instrument includes a sheet dispenser that has only the base and the cover is optional. In such an application, the stack of sheets can be adhered to the base.

FIGS. 11 to 14 depict various views of an exemplary first cap 40 along with a base 70 that can be used in writing instrument of FIG. 1. The base 70 includes a platform 72 where a stack of sheets will be placed. A portion of the platform 72 lie on a portion of the closure portion 42 and a portion of the platform extend from the closure portion. Thus, the platform conveniently functions as a clip for the writing instrument. The clip function is better depicted in FIG. 14 as a gap 48 between the platform 72 and the outer surface of the closure portion 42 of the first cap 40. Along the sides of the platform are channels 76. Extending laterally from the platform are sidewalls 74 and a back wall 75, both of which are proximate to the end portion 44 of the first cap. The sidewalls truncate along a surface 74*a*. Along the channel towards the truncated surface 74*a* is a substantially V-shaped protrusion. On the back wall 75, there is optionally a divot 71 on a bottom surface 75*a*.

When the cover slides onto the base, the channels 76 of the base mates with a rail that is created between the bottom surface 84*a* and the groove 86 of the cover. Thus, the substantially V-shaped protrusion 77 of the base mates with the V-shaped notch 87 of the cover. When completely engaged, the truncated surface 84*a* on the sidewall of the cover lies proximate to, and may even contact, the truncated surface 74*a* of the sidewall of the base. The latch 81 of the cover mates with the divot 71 of the base. The cover slides onto the base such that the tongue 83 lies proximate to the sidewall 74 and back wall 75 of the base and the marking 89 on the cover lies distal to the end portion 42 of the first cap 40.

In one illustrative embodiment, the length of the writing instrument, as measured from an end of the first cap to an end of the second cap is 150 mm to 160 mm. The length of the sheet dispenser, as measured from the back wall 75 of the base to the front wall 85 of the cover is from 40 to 50 mm. In another embodiment, the cover has a length of 44 mm, as measured from the front wall 85 to the tip of the tongue 83. The slot width, W, has a dimension of 13 mm. The sidewall of the cover, as measured from the front wall 85 to the truncated surface 84*a* is 34 mm. The dimension of the platform 72 of the base, as measured from the back wall 75 to the tip of the platform is 43 mm. The platform is sufficiently long and sufficiently wide to hold a stack of sheets.

In general, the stack of sheets is a polymeric or paper based material having a first and second end portions and first and second opposing major surfaces. Each sheet includes a repositionable adhesive disposed on a first portion of its first major surface. In a polymeric sheet, the first portion is typically transparent and is larger in size than the second portion, which is generally brightly colored. A plurality of sheets is releaseably adhered to one another in a fan-fold (also referred to as "z-stacked") configuration such that the repositionable adhesive in alternating sheets lies at alternating ends of the stack. Illustrative sheets and stacks of sheets that may be used in the present invention are disclosed in U.S. Pat. No. 4,907,825 (Miles et al) and assignee's co-pending application U.S. patent application Ser. No. 11/843,235, filed Aug. 22, 2007. In one exemplary embodiment, the stack of sheets does not shuttle from one end of the dispenser to an opposing end of the dispenser. In this case, the longest dimension of the stack of sheets is just slightly smaller than (e.g., about 90% to about 95% of) the length of the dispenser. In another embodiment, the stack of sheets shuttle from one end wall to the opposing end wall. In this case, the length of the stack of sheets is noticeably smaller than the tension of the dispenser. The shuttling of a stack of sheets is disclosed in U.S. Pat. No. 4,907,825.

The writing instrument is typically polymeric and thus can be made by injection molding. In particular, the first cap of the writing instrument, along with the base of the dispenser can be an integral unit, e.g., they can be injection molded as a one-piece unit.

What is claimed is:

1. A writing instrument comprising:

(a) a body having opposing first and second ends, the body comprising a marking element extending from one or both ends, and (b) a sheet dispenser coupled to a first cap, said first cap having a closure portion and an end portion, the closure portion being able to engage the first or the second end of the body portion so that this entire combination encloses and protects the marking element, the sheet dispenser comprising:

(i) a base disposed on the first cap, wherein the base of the dispenser further comprises (1) a substantially flat platform, a portion of which is disposed on the closure portion of the first cap, and (2) a back wall and sidewalls extending laterally from the platform and disposed proximate to the end portion of the first cap; and (ii) a cover removably engageable with the base, wherein the dispenser is disposed axially along a centerline of the writing element.

2. The writing instrument of claim 1 further comprising a stack of sheets disposed in the dispenser.

3. The writing instrument of claim 2 wherein the sheet in the stack of sheets is polymer based or paper based, and wherein the sheets are in a z-fold or non z-fold configuration.

4. The writing instrument of claim 1 wherein the base of the dispenser is integrally formed with the first cap.

5. The writing instrument of claim 1 wherein the platform of the base where a stack of sheets will be placed has an exposed end that is distal to the back wall, and the platform having side channels along its edges.

6. The writing instrument of claim 1 wherein the base of the dispenser functions as a clip.

7. The writing instrument of claim 1 further comprising a second cap engagable with the first or second end of the body.

8. The writing instrument of claim 1 comprising a first marking element extending from the first end of the body and a second marking element extending from the second end of the body.

9. The writing instrument of claim 8 wherein the first writing element is ink marking or fluid marking and wherein the second writing element is ink marking or fluid marking.

10. The writing instrument of claim 1 wherein the cover of the dispenser has a top surface, a slot disposed at about a midpoint of the top surface, sidewalls, and a back wall extending laterally from the top surface.

11. The writing instrument of claim 10 wherein the slot in the cover of the dispenser is nearly the same dimension as that of a stack of sheets disposed in the dispenser.

12. The writing instrument of claim 11 wherein a bottom most sheet in the stack of sheets is adhesively attached to a platform of the base of the dispenser.

13. A cap for a writing instrument comprising a body having a marking element extending from the body, wherein the cap comprises a closure portion adapted to removably engage with the writing instrument so as to enclose and protect the writing element, the closure portion having an outer surface; and a sheet dispenser comprising a base that comprises (i) a platform a portion of which is disposed on the closure portion of the cap and a back wall and sidewalls extending laterally from the platform and (ii) a cover removably engageable with the base;

wherein the sheet dispenser is coupled to the closure portion so as to provide a gap between a portion of the sheet dispenser and a portion of the outer surface of the closure portion.

14. The cap of claim 13 further comprising a stack of sheets disposed in the dispenser.

* * * * *